US005971239A

United States Patent [19]

Marable

[11] Patent Number: 5,971,239

[45] Date of Patent: Oct. 26, 1999

[54] SLING SYSTEM FOR WEAPON WITH TELESCOPIC SIGHT

[76] Inventor: Robert C. Marable, P.O. Box 1048, Aztec, N.Mex. 87410

[21] Appl. No.: 09/066,068

[22] Filed: Apr. 24, 1998

Related U.S. Application Data

[60] Provisional application No. 60/044,605, Apr. 24, 1997.

[51] Int. Cl.[6] ..... F41C 23/02

[52] U.S. Cl. ..... 224/150; 24/2.5

[58] Field of Search ..... 224/150, 913; 24/2.5

[56] References Cited

U.S. PATENT DOCUMENTS

| | | | |
|---|---|---|---|
| 2,102,964 | 12/1937 | Mossberg | 224/150 |
| 2,915,233 | 12/1959 | Moomaw | 224/150 |
| 3,430,828 | 3/1969 | Gregson | 224/150 |
| 3,819,094 | 6/1974 | Fyde | 224/913 |
| 4,431,122 | 2/1984 | Garmong | 224/150 |
| 4,511,070 | 4/1985 | Hightower | 224/150 |
| 4,562,945 | 1/1986 | Erlandson | 224/150 |
| 4,571,872 | 2/1986 | Johnson | 224/150 |
| 4,613,067 | 9/1986 | Gann | 224/150 |
| 5,067,267 | 11/1991 | Ives | 224/150 |
| 5,092,505 | 3/1992 | Olschlager | 224/150 |
| 5,323,940 | 6/1994 | Hart | 224/150 |
| 5,692,654 | 12/1997 | Bell | 224/150 |
| 5,738,256 | 4/1998 | Goff et al. | 224/913 |

*Primary Examiner*—Stephen P. Garbe
*Attorney, Agent, or Firm*—Paul Adams; Rod D. Baker

[57] ABSTRACT

A sling system for use with a rifle or other shoulder-fired weapon. The system comprises a flexible sling strap, two attachments to a rifle scope, and an attachment to the rifle butt.

2 Claims, 3 Drawing Sheets

SLING SYSTEM FOR WEAPON WITH TELESCOPIC SIGHT

BACKGROUND OF THE INVENTION

CROSS-REFERENCE TO RELATED APPLICATIONS

This application claims the benefit of the filing of U.S. Provisional Patent application Ser. No. 60/044,605 entitled Scope Mounted Rifle Sling, filed on Apr. 24, 1997, and the specification thereof is incorporated herein by reference.

BACKGROUND OF THE INVENTION

1. Field of the Invention (Technical Field)

The present invention relates to a sling system for use with a rifle or other shoulder-fired weapon.

1. Background Art

The use of a sling on rifles is of course very old in the art. Such slings are used to carry the rifle in a vertical position with the users arm inserted between the sling and the rifle so that the rifle rests on the back of the user. Such use has been particularly favored for military rifles. The sling strap is typically mounted on the lower edge of the butt of the rifle at the rear end, and to the front rifle support, forearm of the stock on the underside of the barrel. Thus, when the rifle is held in a horizontal position, the sling strap hangs downwardly.

The sling strap is normally attached through mounting or attachment points. For example, the strap is typically formed into a loop, with D-rings at the ends of the strap when the strap is flattened. An attachment device is typically screwed into the wood of the butt and the forward wooden hand rest and may comprise a rotatable stud through which the circular portion of the D-ring passes. Of course, there are a wide variety of sling systems attaching devices to enable quick release of the sling, easy mounting, high strength, and low cost.

It is also well known in the art to mount a telescopic sight on a rifle or other shoulder-fired weapon. (The term "shoulder-fired" refers to the position in which the rifle or gun is normally held during firing.) This telescopic sight or "scope" has become a regular feature on sportsman's rifles used in hunting. Scopes now come in a wide variety of sizes and shapes and particularly in various optical magnification ranges for use in different hunting or marksman activities. A scope typically has a barrel or tube of a fixed diameter with enlarged end pieces, the forward end piece serving as a shade for the front lens of the scope and the rearward end piece serving as an eye piece which may be adjustable for focus. A scope is typically mounted on the breech section of the weapon raised slightly above the barrel to provide a comfortable position for the user when the rifle is held in the shooting position with the butt engaging the user's shoulder. Scopes may be mounted in a wide variety of ways including semipermanent mountings, usually through the use of threaded screws, or with a quick-disconnect mounting. The semi-permanent mounting device generally comprises a base which is screwed to the rifle barrel in the area of the breech through two holes that are typically provided by the rifle manufacturer and which are tapped to receive a machine screw. The base may be a single piece or two separate pieces to accommodate the shell insert and ejection opening. A typical scope may have a tube that is from six to ten inches in length. The base of the scope mounting device is generally half that length. At a distance of three to four inches apart, mounted on the base, there are two yokes comprising a lower half which is attached to the base, either semi-permanently or integrally therewith. The two spaced apart yokes' lower halves define a semi-cylindrical rest into which the tube of the telescopic sight is placed. The lower yoke half has two ears that project laterally with machine-screw tapped holes. The yoke also comprises an upper half which is a mating piece having an inside semi-cylindrical shape to fit the barrel and two ears which overlie the ears on the bottom half. The upper half of the yoke is attached to the lower half through threaded machine screws when be tightened securely holds the scope in place. Positioning of the scope is of course critical for accurate sighting and performance.

While the sling system that is attached to the lower surfaces of the rifle have been typical for military applications where the user may be engaged in long marching activity and providing a high level of comfort for carrying the rifle is important, there are various disadvantages to a sling system in which the strap is mounted to the lower surfaces of the rifle. For example, in most sporting activities it is highly desirable to carry the rifle comfortably but in the ready position so that the rifle may be quickly brought up to the user's shoulder and fired. It is also highly desirable for a sportsman to carry the rifle while maintaining both hands free, such as to drive an off road vehicle that may be used in the hunting expedition. The sling mounted rifle may be used so that the user's head is inserted through the loop between the rifle and the sling strap and the strap overlies both shoulders with the rifle hanging free, in a generally horizontal position, in front of the user. In that configuration, if the user is not supporting the rifle, the rifle will hang in an upside down position. An alternative means of carrying the rifle with the sling is to place both the head and one arm of the user through the opening between the sling and the rifle so that the strap overlies one shoulder and is diagonal across the front and back. In that position, with the typical sling system, the rifle will be supported, when hands free, in an upside down position. It will be readily appreciated that in the upside down position the rifle is not as readily grasped and brought to the shoulder ready to fire. Alternatively, if the rifle is not supported in the upright position by grasping the rifle with both hands, the weight of the rifle is being carried by the arms of the user rather than by the strap.

One of the reasons why an under-rifle system is used is that if the rifle was used without a scope, the front sling strap mount or attachment would be above the barrel and thus interfere with sighting of the rifle. However, if the rifle includes a scope, it may be possible to attach the front sling system mount without interfering with the use of the rifle during sighting.

SUMMARY OF THE INVENTION (DISCLOSURE OF THE INVENTION)

In summary, the invention comprises a sling system for a shoulder-fired weapon, such as a rifle, including a telescopic sight or scope in which the sling includes a strap used for supporting the weapon when not in use, strap attaching devices carried by the scope at spaced apart positions, and an additional strap attaching device mounted on the upper or top surface of the butt of the weapon. In use, the sling strap may be attached at both ends to the two strap attaching devices carried by the scope, or alternatively, one of the strap ends may be attached to the scope, and the other to the attaching device on the upper surface of the butt of the weapon.

It is therefore an object of the present invention to provide an improved sling system for a rifle, shotgun or other shoulder-fired weapon.

It is another object of the present invention to provide a sling system for a rifle with a scope in which the front and back attaching sling devices are mounted entirely to the tube of the scope.

It is still another object of the present invention to provide a sling mounting system for a rifle or other shoulder-fired weapon having a scope in which the front attaching device for the sling strap is secured to the scope and the rear strap attaching device is secured to the upper end or top surface of the butt of the weapon.

It is yet another object of the present invention to provide a sling system for a weapon with a telescopic sight in which the sling strap may be attached at the front end to the scope and at the rear end alternatively to the scope or to an attachment device on the upper surface of the butt of the weapon.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrates several embodiments of the present invention and together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS

(BEST MODE FOR CARRYING OUT THE INVENTION)

Figure 1:
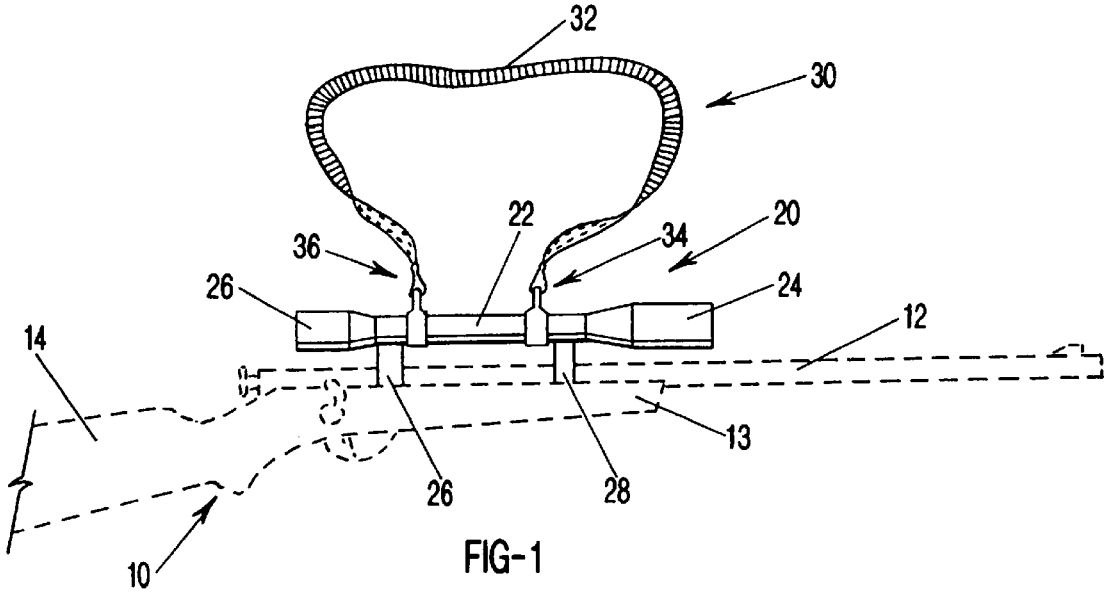
FIG. 1 is a side elevation view showing a rifle with a telescopic sight and the sling system of the present invention.
Figure 2:
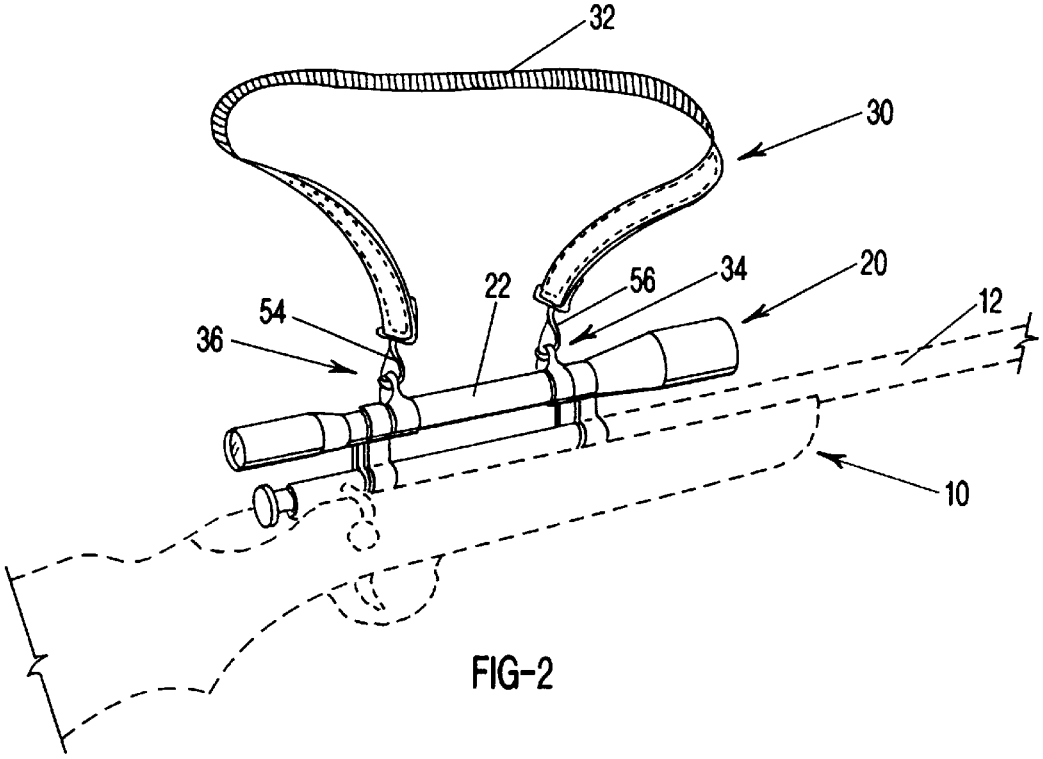
FIG. 2 is a perspective view of the invention shown in FIG. 1.

Referring now to FIG. 1, there is shown a rifle in phantom view indicated generally at 10 including a rifle barrel 12, a forearm forming part of the wooden stock of the rifle 13, and the butt 14 of the stock.

Mounted on the rifle barrel is a telescopic sight indicated generally at 20 including a tube 22, of generally cylindrical shape, an enlarged cylindrical portion 24 at the forward end of the scope providing a sunshade for the front lens, and a rearward enlarged portion 26 comprising the eye-piece for the scope. The scope is mounted to the barrel 12 of the rifle 10 through mounting devices 26, 28. There are a variety of mounting devices for telescopic sights for various types of rifles or other weapons which are well-known in the art.

A sling system 30 is shown in FIG. 1–5 comprising a sling strap 32 which may be of a fixed or adjustable length, and attaching means 34, 36 which are spaced apart, typically four or five inches, and attached to the tube 22 of the scope 20. As seen best in FIG. 6A, one attaching means may comprise a yoke assembly 40 which includes an upper half 42 and a lower half 44. Each half includes ears indicated at 46 and 48 on opposite sides of the opening formed by the U-shaped members 42, 44 through which machine screws or the like may be inserted so as to clamp the upper and lower yoke halves 42, 44 around the tube 22 of the scope 20. Attached to the upper surface of the upper half 42 of the yoke is a rotatably mounted tab 50 having an opening 52. As seen best in FIG. 2, conventional clips 54 and 56 may be attached through the openings 52 of the tabs 50 on each side of the yoke assemblies 40.

Figure 6A:
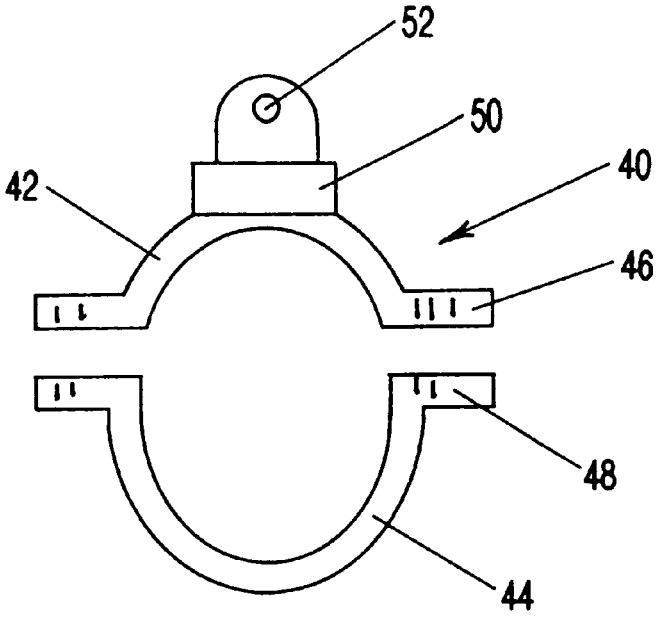
FIGS. 6A–6B are elevation views showing two embodiments of the sling system attaching means.
Figure 6B:
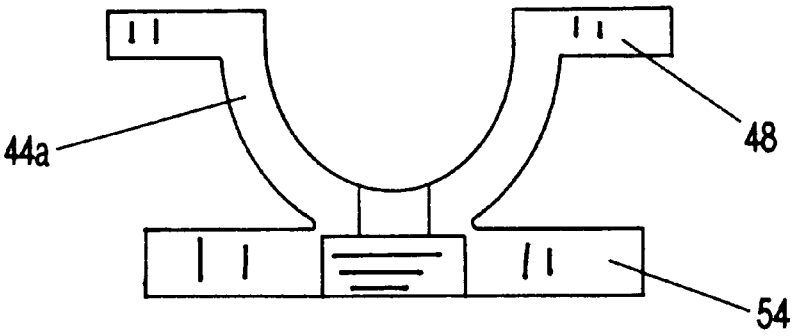

An alternative attaching means for the sling system is shown in FIG. 6B in which the mounting device for the scope is integral with the sling strap attaching means. In this configuration, the lower yoke half 44 as shown in FIG. 6B is integral with a base 54 that is attached directly to a land on the barrel 12 of the rifle 10. Ears 46 and 48 are used to clamp the upper and lower halves 42, 44*a*. Upper half yoke 42 is identical to the upper yoke half in FIG. 6A.

Figure 4:
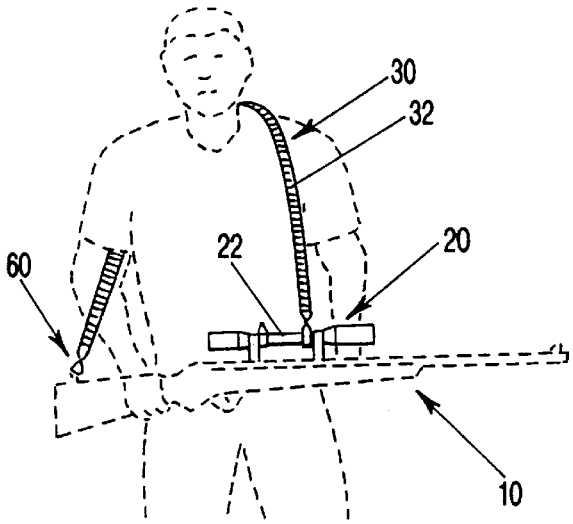
FIG. 4 is a view as in FIG. 3, except that the sling strap has been mounted at the rear end to attaching means on the butt of the rifle.

Referring now to FIG. 4, it will be seen that one embodiment of the invention provides an attaching means 60 for the sling strap 32 on the upper surface of the butt 14 of the stock of the rifle 10. The attaching means 60 may be similar to that shown at 34 and 36 or other attaching devices which are well-known in the prior art available from manufacturers such as Michaels of Oregon, P.O. Box 13010, Portland, Ore. 97213 may be used.

Figure 3:
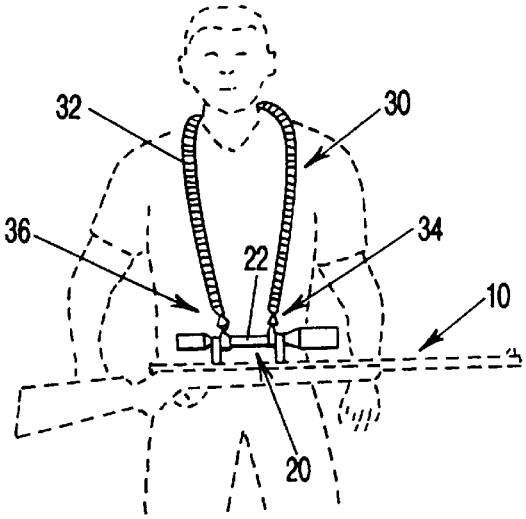
FIG. 3 is a view of a rifle-user showing the sling system of the present invention attached to rope and supported for hands-free carrying.
Figure 5:
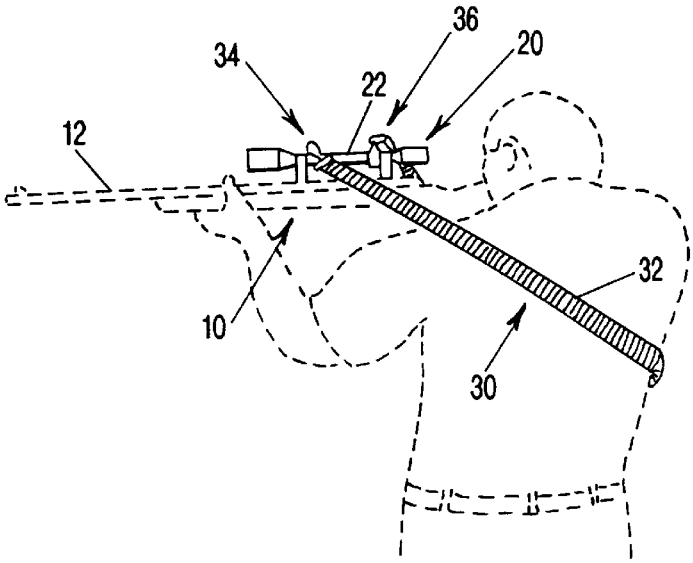
FIG. 5 is a view showing the position of the sling strap when the rifle is in the shoulder-fired position.

Referring now to FIGS. 3–5, the advantageous features of the invention are illustrated by showing the manner in which the rifle may be supported at various times during use. As shown in FIG. 3, the rifle may be supported in a hands-free configuration by attaching the front and rear end of the sling strap 32 to the attaching devices 34, 36 on the tube 22 of the scope 20. The user's head is then placed in the loop formed by the strap 32 so that the rifle hangs from the strap in an upright position and generally horizontal. This hands-free configuration permits the user to use his or her hands to, for example, drive a vehicle, ride a horse or engage in other activities.

The alternative configuration is shown in FIG. 4 where the front end of the strap 32 is attached to the barrel 22 of scope 20 at the front end through an attaching device, such as 34, while the rear end of strap 32 is attached to the attaching means 60 at the butt of the rifle. In this configuration, the user places both head and one arm, (the right arm as shown in FIG. 4) through the loop formed by the strap so that the rifle is again hanging in an upright position. In this configuration, the user must balance the rifle so that it continues to hang in the horizontal position by grasping the stock near the trigger of the rifle.

In FIG. 5 the position of the sling system strap is shown when the rifle is held at-the-ready or in the firing position. It will be seen that the strap is then positioned around the upper body of the user, the rear end of the strap being attached to the butt of the rifle or to the scope as shown, and the forward end attached to the scope. In this position, the scope is entirely out of the way of the line of sight of the user whether sighting directly through the telescope or looking down the barrel of the rifle for a more panoramic view.

It will therefore be seen that the sling system of the present invention may be carried out in several different embodiments allowing the strap to be attached entirely to the scope, or at one end to the scope and at the other end to another portion of the rifle. Furthermore, the attaching means of the present invention may comprise various mechanical couplings which attach the strap ends to the tube of a telescope sight or to the mounting device for the scope which may be configured so as to provide a connection to the end of the strap. Various attaching devices will be obvious to those having ordinary skill in the art.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A sling system for a shoulder-fired weapon with a butt and a scope, said sling system comprising:

a flexible sling strap for supporting the weapon when worn by a user;

first and second attaching means, each of said means attaching one end of said sling strap to the scope; and third attaching means for attaching one end of said sling strap to the top side of the butt, whereby the sling may be attached at both ends to the scope for hands-free carrying by the user and attached at one end to the scope and at the other to the butt for at-the-ready carrying by the user.

2. An improvement for a sling system for a rifle or other shoulder-fired weapon having a a butt and a scope, the scope having a cylindrical tube and an eye-piece, a pair of scope mounting devices spaced apart and each engaging the cylindrical tube, each of the devices comprising a yoke, a lower half of the yoke mounted on the weapon and an upper half of the yoke secured to the lower half through fasteners, and a sling strap, said improvement comprising:

first and second sling attaching means affixed to the yoke upper half of each of said scope mounting devices; and a third sling attaching means permanently attached to an upper edge of the butt of the weapon, whereby said sling strap may be attached at the forward end to one of said first or second attaching means and at the rearward end, alternatively, to the second of said first and second attaching means or the third sling attaching means.

* * * * *